US008381716B2

(12) United States Patent
Bettinzoli et al.

(10) Patent No.: US 8,381,716 B2
(45) Date of Patent: Feb. 26, 2013

(54) FLAME IGNITION DEVICE FOR GAS BURNERS

(75) Inventors: Angelo Bettinzoli, Concesio (IT); Emilio Placer Maruri, Pamplona (ES); Pedro Herrera Estrada, Pamplona (ES); Jose Leon Garcia, Pamplona (ES); Luis Antonio Palacios Valdueza, Pamplona (ES)

(73) Assignees: SABAF S.p.A., Ospitaletto (BS) (IT); BSH Bosch und Siemens Hausgeraete GmbH, Munich (DE)

( * ) Notice: Subject to any disclaimer, the term of this patent is extended or adjusted under 35 U.S.C. 154(b) by 1417 days.

(21) Appl. No.: 11/912,815

(22) PCT Filed: Apr. 20, 2006

(86) PCT No.: PCT/IB2006/000953

§ 371 (c)(1),
(2), (4) Date: Oct. 26, 2007

(87) PCT Pub. No.: WO2006/114675

PCT Pub. Date: Nov. 2, 2006

(65) Prior Publication Data

US 2008/0213713 A1 Sep. 4, 2008

(30) Foreign Application Priority Data

Apr. 27, 2005 (IT) ..... MI20050147 U

(51) Int. Cl.
*F24C 3/10* (2006.01)

(52) U.S. Cl. ..... 126/258; 126/256; 200/61.86

(58) Field of Classification Search ..... 431/258, 431/254, 255, 256, 257; 200/68.1, 61.86, 200/564, 336

See application file for complete search history.

(56) References Cited

U.S. PATENT DOCUMENTS 6,627,828 B1 9/2003 McCartney
6,646,214 B1 * 11/2003 Home ..... 200/61.86

FOREIGN PATENT DOCUMENTS

CA 2387601 X 11/2003

* cited by examiner

*Primary Examiner* — Alfred Basichas
(74) *Attorney, Agent, or Firm* — Lucas & Mercanti, LLP

(57) ABSTRACT

A flame ignition device for a gas burner is described, comprising at least one ignition circuit and electric switching means that are associated with the gas tap for the respective burner. The electric switching means include at least one electric contact member (50) which is integral, at least in translation, with the control rod of said gas tap.

8 Claims, 3 Drawing Sheets

FLAME IGNITION DEVICE FOR GAS BURNERS

FIELD OF THE INVENTION

The present invention relates to a flame ignition device for gas burners. A device according to the invention is applied, for example, to obtain flame ignition in kitchen burners.

BACKGROUND OF THE INVENTION

In kitchen gas burners, such as burners arranged on the kitchen cooktops, each burner is controlled by means of a gas tap and a spark plug is arranged proximate to each burner to obtain the gas ignition when a determined action is performed on the control rod of the corresponding tap.

The spark plugs are supplied by a suitable ignition circuit, such as an electronic circuit, which is capable of energizing the spark plugs in order to cause a series of electric discharges with a preset frequency in proximity of each burner.

A switching means is associated with each tap, which generally consists of a micro-switch allowing to activate or deactivate the ignition circuit.

However, complications may occur when the micro-switches are mounted on the gas taps both in the design step and during manufacture.

It is a general object of the present invention to propose a flame ignition device in gas taps which is particularly easy and cost-effective to provide.

SUMMARY OF THE INVENTION

This object is achieved according to the invention due to a flame ignition device for a gas burner, comprising at least one ignition circuit to electrically supply at least one spark plug that is associated with the burner and electrical switching means associated with the gas tap for the respective burner and electrically connected to the ignition circuit to selectively activate or deactivate the power supply to the spark plug, characterized in that the electric switching means include at least one electric contact member which is integral, at least in translation, with the gas tap control rod.

The electric contact member includes at least one portion made of electrically conductive material, which is suitable to be selectively contacted with at least one portion made of electrically conductive material integral with the tap.

According to an advantageous aspect of the invention, the electric contact member is totally made of an electrically conductive material and is fixed on a support member that is made of electrically insulating material. Furthermore, the portion made of electrically conductive material that is integral with the gas tap may advantageously consist of a part of the tap.

The device according to the invention thus results to be particularly easy and inexpensive to manufacture and does not require the use of micro-switches to be assembled to the tap.

BRIEF DESCRIPTION OF THE DRAWINGS

Further characteristics and advantages of the invention will be more apparent from the following description, which is given by way of example with reference to the annexed schematic drawings, in which.

MODES FOR CARRYING OUT THE INVENTION

Figure 1:
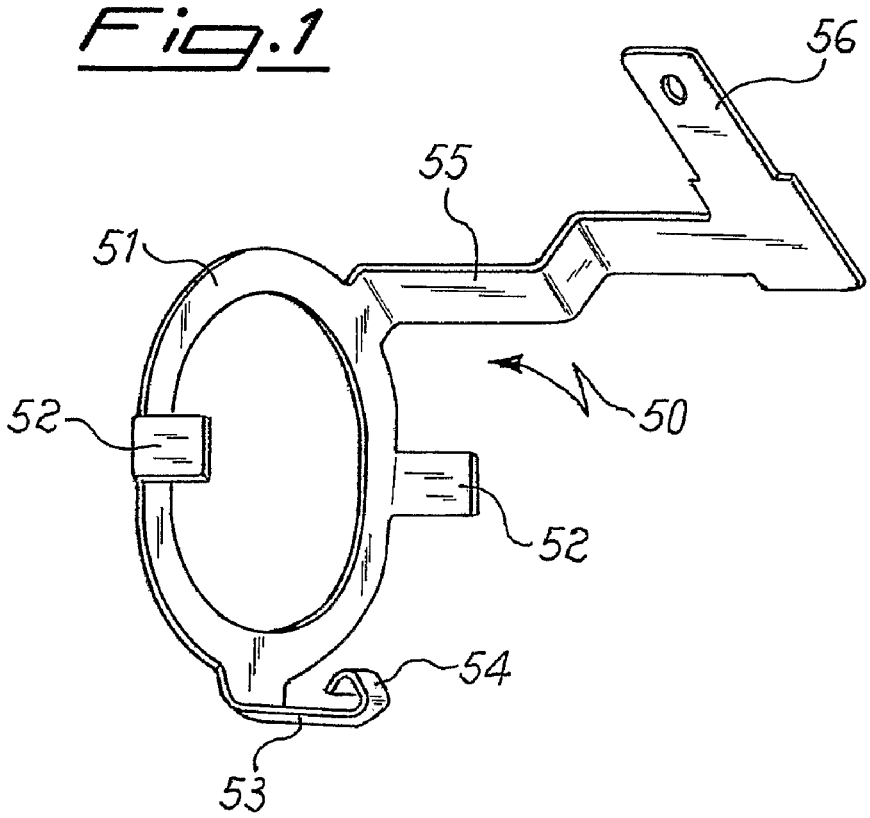
FIG. 1 is a perspective view of a possible embodiment of an electric contact member for an ignition device according to the invention.

In FIG. 1 there is detailed a possible embodiment of an electric contact 50 which is one of the switching means associated with a determined gas tap.

The electric contact 50 as depicted in FIG. 1 is totally made of an electrically conductive material in the form of a suitably shaped and folded sheet metal. Particularly, the electric contact 50 comprises an annular portion 51 and a pair of tongues 52 protruding therefrom which facilitate securing and holding the latter in position within a support member 60 (FIG. 2) which is made of an electrically insulating material.

The electric contact 50 further includes a first tab 53 with a suitably shaped end 54 to provide a sliding contact with a portion made of electrically conductive material of the tap to which the electric contact 50 is associated.

A second tab 55 of the electric contact 50 is provided, on the other hand, with a shaped end 56 to engageably receive an electric connection member of a preset type (not shown), such as a Faston™ contact or the like.

Figure 2:
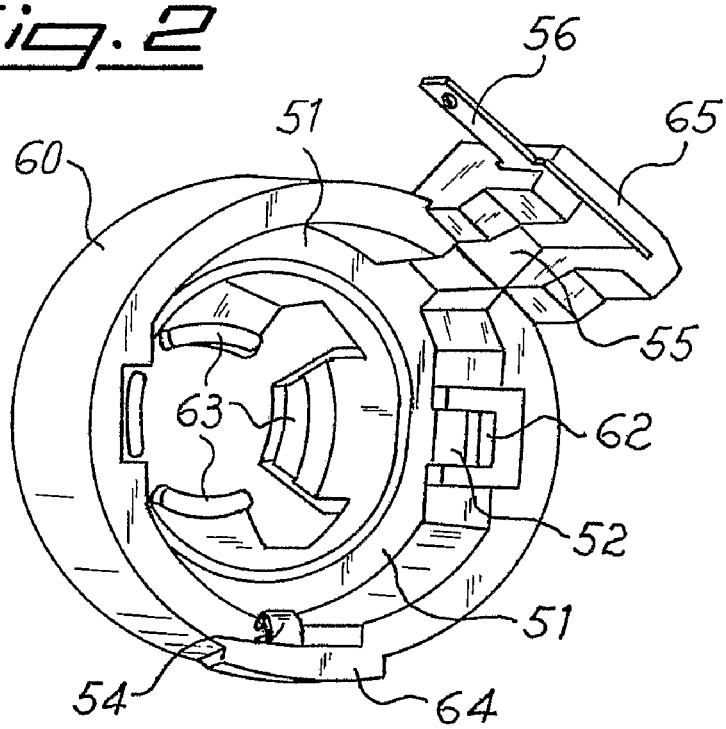
FIG. 2 is a perspective view of a possible embodiment of an electric contact member being mounted to an insulating support for an ignition device according to the invention.

In FIG. 2 there is illustrated a support member 60, an electric contact 50 such as that illustrated in FIG. 1 being fittingly mounted thereon. The electric contact 50 is inserted within the support member 60 and locked in position by means of teeth 62 against which the locking tongues 52 are abutted, which have been elastically deformed while being inserted.

A shaped portion 65 of the support member 60 isolates the tab 55 and leaves only the connection end 56 uncovered, whereas the end 54 intended to be contacted to a conductive portion of the tap is housed at a shaped portion 64.

The support member 60 further comprises a central hole, in which projections 63 are faced that are suitable to allow the support/contact assembly to be mounted on a tap control rod and made integral thereto, at least in translation.

Figure 3A:
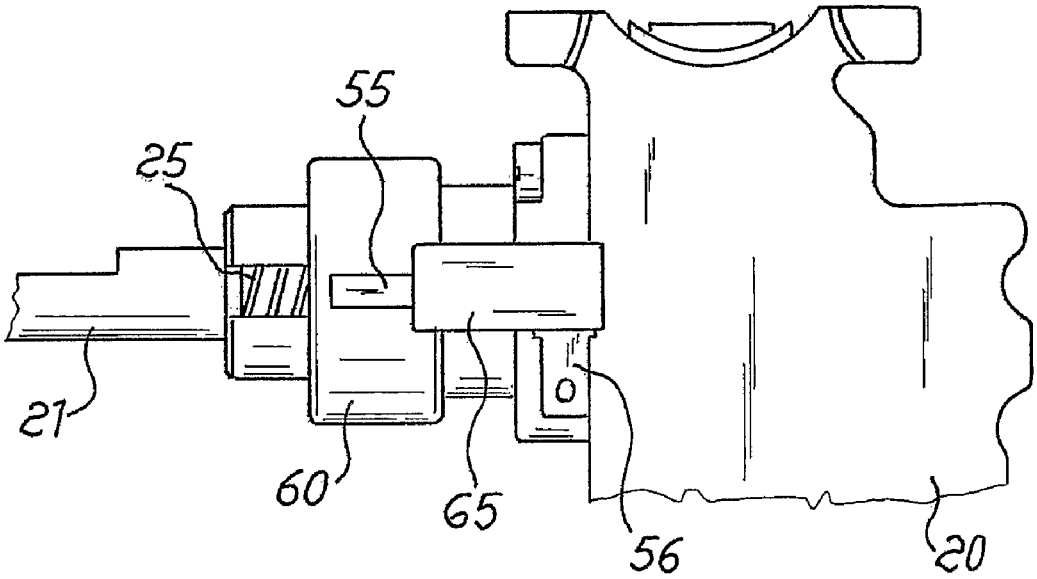
FIG. 3A is a side elevation view showing a gas tap provided with electric switching means according to the invention with the control rod being at rest.
Figure 3B:
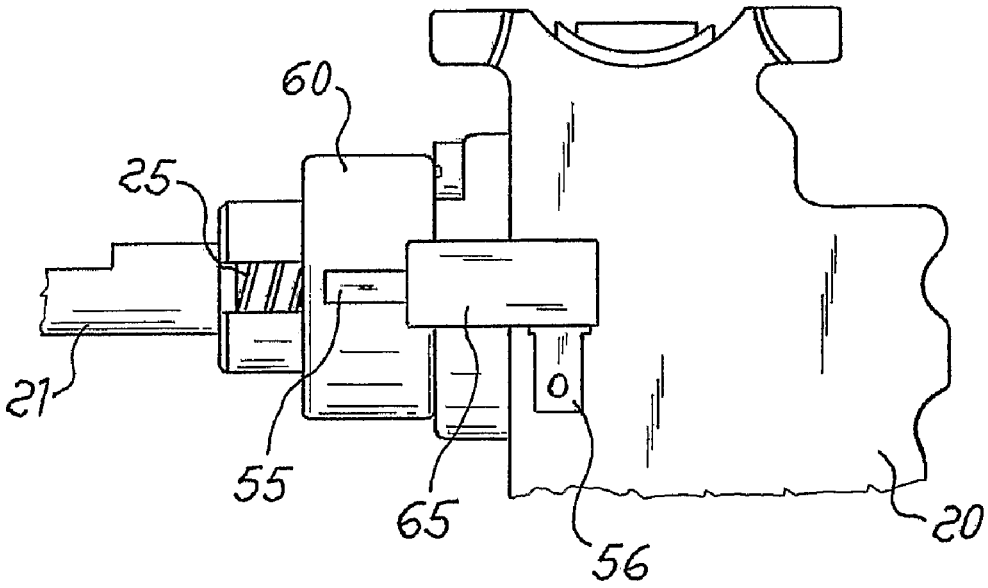
FIG. 3B is a side elevation view showing a gas tap provided with electric switching means according to the invention with the control rod being pressed.

A tap provided with a switching means according to the invention is illustrated in FIGS. 3A and 3B, respectively, in a rest condition (FIG. 3A) and in a pressed condition due to a pressure being applied on the tap control rod (FIG. 3B).

In these figures, in fact, a gas tap 20 is illustrated as being provided with a control rod 21 to which there is mounted a support member 60 together with a contact member 50. However, only some parts of the latter can be seen. On the control rod 21 there may be provided an elastic return means, such as a helical spring 25 to ensure that the support/contact assembly returns in position when the axial pressure on the control rod 21 is interrupted.

From the comparison between FIGS. 3A and 3B it may be seen that the entire support/contact assembly moves integrally with the control rod 21 in the axial direction relative to the tap body 20.

Figure 4A:
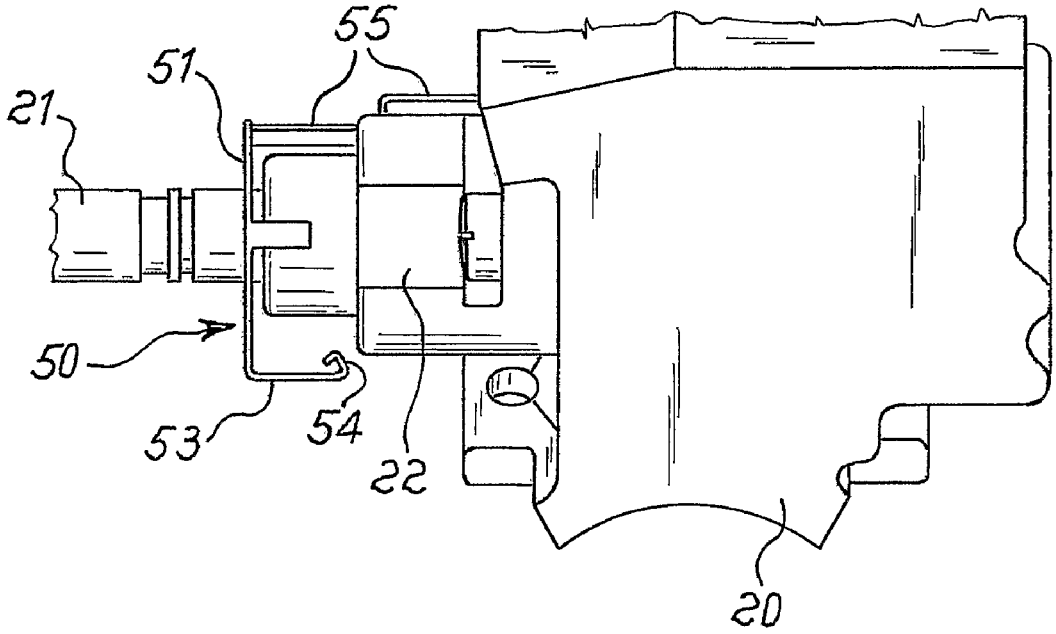
FIG. 4A is a perspective view of a gas tap with some details being omitted in order to better illustrate the electric contact member in the open circuit condition.
Figure 4B:
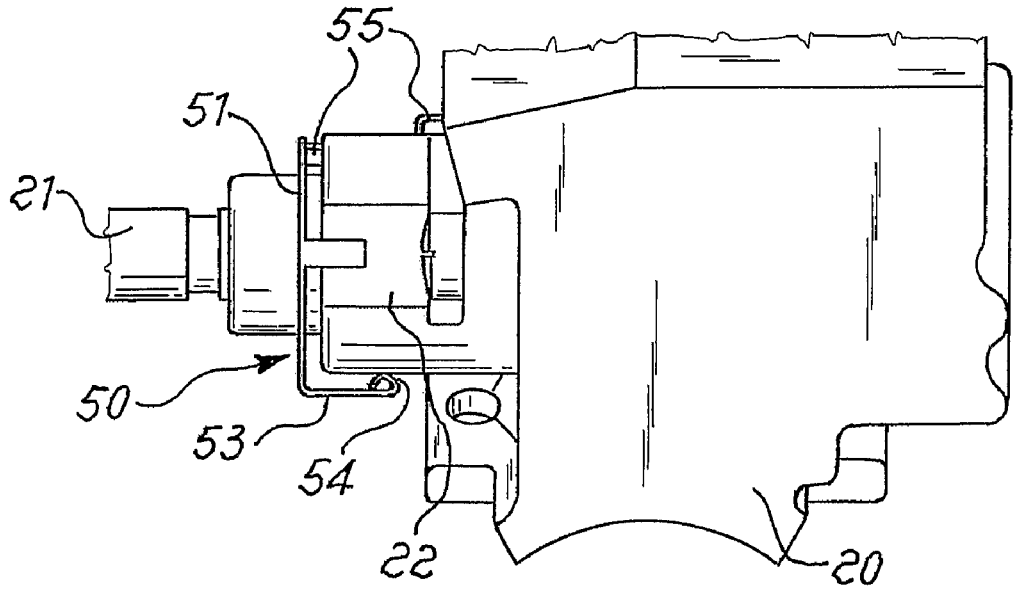
FIG. 4B is a perspective view of gas tap with some details being omitted in order to better illustrate the electric contact member in the closed circuit condition.

The operation of the contact member 50 being associated with a tap 20 is better seen in the illustration of FIGS. 4A and 4B, in which the electric contact 50 is illustrated without support member and any return spring 25.

In FIG. 4A, the control rod 21 is in the rest position, at which the electric contact member 50 remains open and deactivates the contact with a portion of the tap 20 that is made of electrically conductive material. A sliding contact (FIG. 4B) is provided on the cap 22 of the tap 20 by applying an axial pressure on the tap control rod 20.

In the embodiment as illustrated by way of example, the cap 22 and the tap body 20 to which it is attached are made of electrically conductive material. Alternatively, it may also be envisaged that the current passage is provided between the electric contact 50 and a portion made of electrically conductive material being associated with the tap 20 though isolated therefrom.

In the position in FIG. 4B, the electric contact 50 closes the circuit on the tap 20 thus enabling in this position the power supply to the spark plugs through the ignition circuit thereof.

A contact member according to the invention is particularly versatile and can be used for opening or closing a low voltage circuit, either included or associated with the ignition circuit, or may also be used for selectively applying or excluding a particular low voltage signal to/from a particular section of the ignition circuit.

The invention claimed is:

1. A flame ignition device for a gas burner, comprising at least one ignition circuit to electrically supply at least one spark plug that is associated with said burner and electrical switching device associated with a gas tap for the respective burner and electrically connected to said ignition circuit to selectively electrically couple a power supply to said at least one spark plug, wherein said electric switching device comprises at least one electric contact member which is integral, at least in translation, with a control rod of said gas tap and an electrically insulating support member such that the electric contact member and support member are operatively coupled to the support rod, axial movement of the support rod provides axial movement of the electric contact member and support member in an axial direction of the control rod with respect to the gas tap such that the electric contact member engages the gas tap to provide electrical coupling.

2. The device according to claim 1, wherein said electric contact member is totally made of an electrically conductive material.

3. The device according to claim 1, wherein at least one support member is made of electrically insulating material, said electric contact member being operatively coupled thereto.

4. The device according to claim 1, wherein said electric contact member comprises at least one electrically conductive portion suitable to engageably receive an electric connection member of a preset type.

5. The device according to claim 1, further comprising a return elastic device which engages said support member to move away and separate said electric contact member from said at least one portion made of electrically conductive material which is integral with said gas tap when the control rod of said tap is brought back to a first position.

6. The device according to claim 1, wherein the control rod of said gas tap is movable in translation between at least a first position, at which said electric contact member deactivates the operation of said ignition circuit, and at least a second position in which said electric contact member activates the operation of said ignition circuit.

7. The device according to claim 1, wherein said electric contact member includes at least one portion made of electrically conductive material which is suitable to be selectively contacted with at least one portion made of electrically conductive material integral with said gas tap.

8. The device according to claim 7, wherein said at least one portion made of electrically conductive material which is integral with said gas tap comprises at least a part of said gas tap.

* * * * *